US007965954B2

(12) United States Patent
Shiori et al.

(10) Patent No.: US 7,965,954 B2
(45) Date of Patent: Jun. 21, 2011

(54) IMAGE FORMING APPARATUS

(75) Inventors: Jun Shiori, Kanagawa (JP); Toshihiro Sugiyama, Tokyo (JP); Atsushi Tano, Kanagawa (JP); Tadashi Kasai, Kanagawa (JP); Yutaka Takahashi, Kanagawa (JP); Takehide Mizutani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 581 days.

(21) Appl. No.: 11/954,297

(22) Filed: Dec. 12, 2007

(65) Prior Publication Data

US 2008/0138094 A1 Jun. 12, 2008

(30) Foreign Application Priority Data

Dec. 12, 2006 (JP) ..... 2006-335137
Jan. 9, 2007 (JP) ..... 2007-001619
Mar. 15, 2007 (JP) ..... 2007-067205

(51) Int. Cl.
*G03G 15/06* (2006.01)

(52) U.S. Cl. ..... 399/55; 399/72; 399/94; 399/97

(58) Field of Classification Search ..... 399/9, 38, 399/44, 49, 55, 72, 74, 94, 97
See application file for complete search history.

(56) References Cited

U.S. PATENT DOCUMENTS

2005/0157327 A1* 7/2005 Shoji et al. ..... 358/1.14

FOREIGN PATENT DOCUMENTS

| | | |
|---|---|---|
| JP | 63-289563 | 11/1988 |
| JP | 4-258080 | 9/1992 |
| JP | 7-168484 | 7/1995 |
| JP | 8-262818 | 10/1996 |
| JP | 11-84829 | 3/1999 |
| JP | 2000-19818 | 1/2000 |
| JP | 2003-178153 | 6/2003 |
| JP | 2004-345091 | 12/2004 |
| JP | 2005-176045 | 6/2005 |

OTHER PUBLICATIONS

U.S. Appl. No. 12/210,715, filed Sep. 15, 2008, Takahashi et al.

* cited by examiner

*Primary Examiner* — David P Porta
*Assistant Examiner* — Benjamin Schmitt
(74) *Attorney, Agent, or Firm* — Oblon, Spivak, McClelland, Maier & Neustad, L.L.P.

(57) ABSTRACT

A control unit controls a device that executes an image forming process, compares changes of each toner adhesion amount in an image-density-detection pattern image when a developing-bias control condition is changed, with respect to a toner adhesion amount in an image-density-detection pattern image in a normal status, performs a malfunction-occurrence prediction process according to the degree of each change of the densities, and displays the result.

8 Claims, 5 Drawing Sheets

IMAGE FORMING APPARATUS

CROSS-REFERENCE TO RELATED APPLICATIONS

The present application claims priority to and incorporates by reference the entire contents of Japanese priority documents, 2006-335137 filed in Japan on Dec. 12, 2006, 2007-001619 filed in Japan on Jan. 9, 2007 and 2007-067205 filed in Japan on Mar. 15, 2007.

BACKGROUND OF THE INVENTION

1. Field of the Invention

The present invention relates to an image forming apparatus capable of detecting a malfunction of a mechanism that determines a malfunction of an element or a device used for image forming processes and also detecting a malfunction of a charging unit before these malfunctions may lead to an abnormal image.

2. Description of the Related Art

Image forming apparatuses such as copiers, printers, or facsimiles and printing machines can obtain a printout in such a manner that a developing unit visualizes an electrostatic latent image formed on a photosensitive element that is a latent-image carrier and a visualized image is transferred to a sheet or the like.

Japanese Patent Application Laid-open No. S63-289563 discloses a configuration of performing self-diagnosis of devices and elements used in an image forming process in an image forming apparatus.

In the disclosed configuration, by comparing each current value at devices other than a paper feeder when load is applied thereto based on actual image forming conditions with a reference value and when the detected current value falls within an allowable range, it is determined that there is no malfunction. In this method, however, the self-diagnosis is performed on the image forming apparatus only upon start of operation thereof, and if the result of the self-diagnosis at that time is satisfactory, then it is just determined that there is no malfunction. Thus, it is understood that the method is not configured to predict occurrence of a malfunction of the image forming apparatus.

Therefore, even if no malfunction occurs under operational conditions at the current stage, it is impossible to predict and determine the occurrence of a malfunction when the devices may be degraded due to continuation of the state and affected by environmental fluctuations. Consequently, if a malfunction occurs, then it is urgently required to response to the occurrence of the malfunction, and the imaging operation may thereby be interrupted. Especially, the device used in the charging process that is inevitably executed to form an image cannot set a predetermined potential on the photosensitive element caused by abnormal charging due to degradation of the device with the passage of time. In this case, if the background potential of the photosensitive element is different from a predetermined value, then the density of an image may be decreased.

The charging process in an electrophotographic device is a process of uniformly charging a specific dielectric element that is a photosensitive element or a latent-image carrier. A method of charging the photosensitive element is roughly classified into two methods such as a non-contact charging method and a contact charging method. A now commonly used charging method is a corona charging method typically used in a corotron charger and a scorotron charger which are included in the non-contact charging method.

However, the chargers using the corona charging method produce ozone. Therefore, due to ozone regulation based on recent environmental problems, the mainstream of the corona charging method used in low speed and intermediate speed electrophotographic devices is shifting to the contact charging such as a roller charger and a brush charger which produce a small amount of ozone. To achieve more uniform charging, the scorotron charger is provided with a grid near a wire through which an electrical current passes, and the roller charger is configured to superimpose an alternating current (AC) on a direct current (DC).

Japanese Patent Application Laid-open No. 2004-345091 describes a technology for dividing an input image and an output image into n blocks to be subjected to color shift correction and color correction of images, performing pattern matching for each divided block, and comparing patterns. However, in this technology, only current quality of an image forming apparatus can be obtained, and thus it is impossible to predict that an image will become abnormal such as color shift in ordinary use.

Japanese Patent Application Laid-open No. 2005-176045 describes a technology for reading an abnormal-image detection chart by an image reader to identify which of a printer side and a reading side has a factor of an abnormal image such as inclination. However, in this technology also, only current quality of an image forming apparatus can be obtained, and thus it is impossible to predict that the image will become abnormal such as color shift in ordinary use.

However, the following problems remain in the charging process. More specifically, in the non-contact charging and the contact charging, a charging failure due to electrical discharge and dirt may occur with the passage of time in a portion such as a wire or a roller used to directly charge a photosensitive element. The charging failure causes a line to appear also in a sub-scanning direction of an image usually as a color streak. The portion where the charging failure has once occurred is difficult to recover, and the portion becomes a factor of short life of a unit to which a charging unit belongs. Occurrence of an abnormal image due to the charging failure does not allow to obtaining a normal image.

Furthermore, to prevent an abnormal image due to the charging failure, the life of the unit has to be decided so as to have a certain allowance. This does not make maximum use of the life, which leads to an increase in costs.

SUMMARY OF THE INVENTION

It is an object of the present invention to at least partially solve the problems in the conventional technology.

An image forming apparatus according to one aspect of the present invention includes an image forming unit that forms an electrostatic latent image on a photosensitive element by an electrophotographic process, and causes toner to adhere to the electrostatic latent image to form a visible image and a control unit that controls the image forming unit. At least a toner-adhesion-amount detector that detects a toner adhesion amount in an image-density-detection pattern image formed on the photosensitive element, an operating unit through which image formation is instructed, and a detection sensor that detects temperature and humidity in proximity of the image formation are connected to an input side of the control unit. At least a developing bias control unit that controls a developing-bias control condition in a developing process, a display unit that can display thereon a malfunction, and a communicating unit that displays a malfunction on an external device via a network are connected to an output side of the control unit. The control unit compares changes of a toner adhesion amount in the image-density-detection pattern image when the developing-bias control condition is changed with respect to a toner adhesion amount in the image-density-detection pattern image in a normal status, performs a malfunction-occurrence prediction process according to a degree of each of the changes in density, and displays a result of the malfunction-occurrence prediction process.

An image forming apparatus according to another aspect of the present invention includes an image input unit that inputs image data; an image forming unit that forms an image on a recording medium based on input image data; an image reading unit that reads the recording medium on which the image is formed, and outputs read image data; an abnormality-detection-image output unit that outputs abnormality-detection image data with which an abnormal image easily occurs caused by a charging unit of the image forming unit; a comparing unit that compares image data output from the image reading unit by reading the recording medium on which the image is formed based on the abnormality-detection image data output by the abnormality-detection-image output unit with the input image data, and outputs a comparison result; and a determining unit that determines whether there is a malfunction of the charging unit based on the comparison result.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
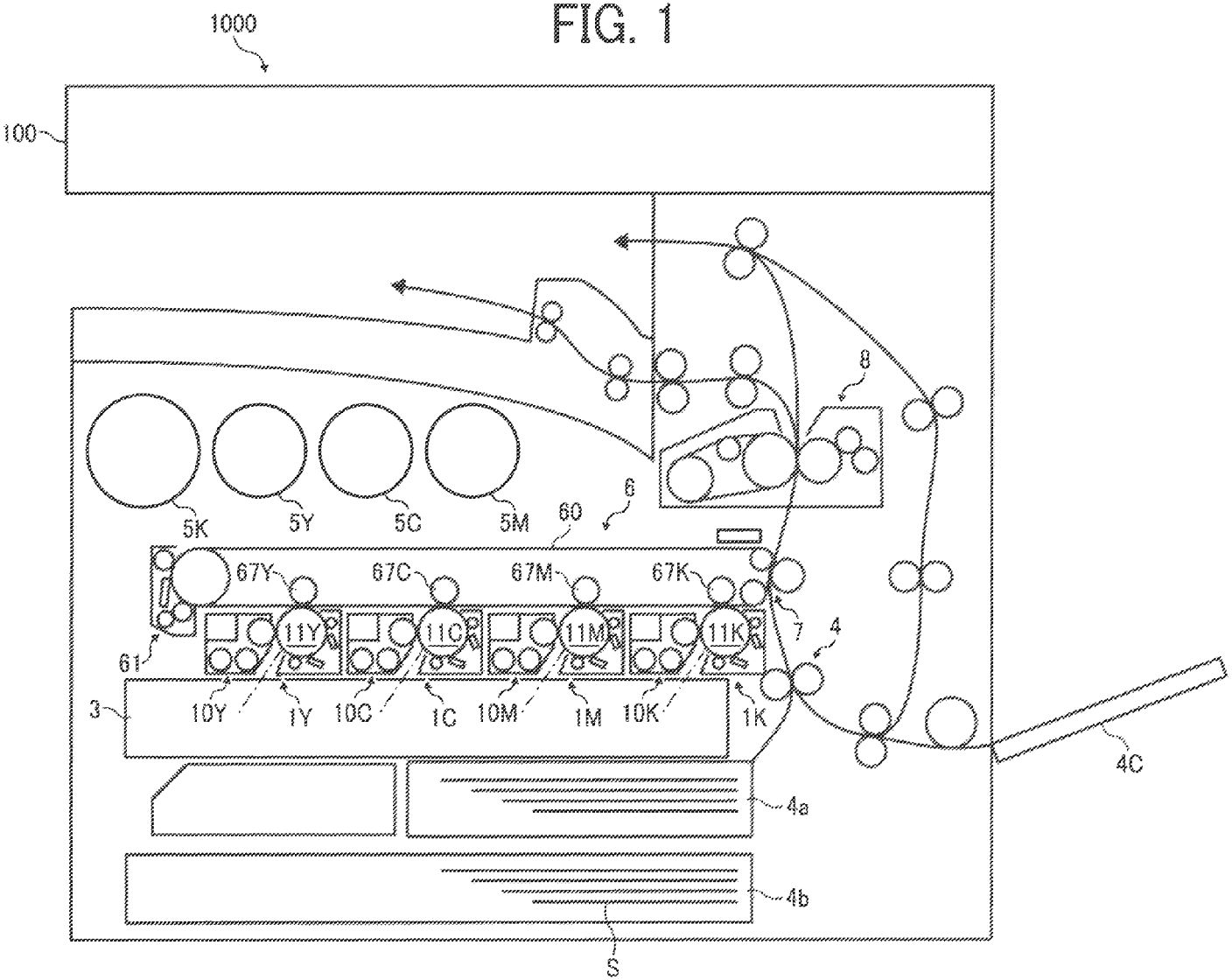
FIG. 1 is a schematic diagram of an image forming apparatus according to one embodiment of the present invention.
Figure 2:
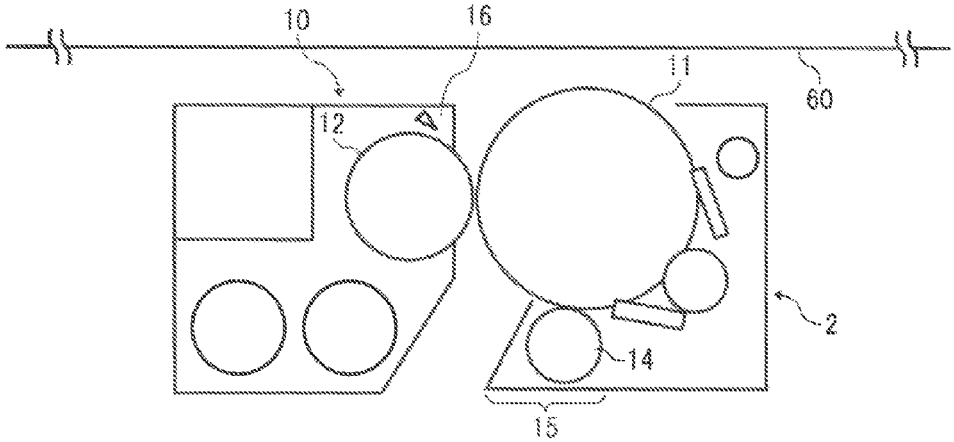
FIG. 2 is a schematic diagram of an image forming unit in the image forming apparatus of FIG. 1.

FIG. 1 is a schematic diagram of an entire configuration of an image forming apparatus according to a first embodiment of the present invention. FIG. 2 is a schematic diagram of an image forming unit in the image forming apparatus of FIG. 1.

An image forming apparatus 1000 includes four image forming units 1Y, 1C, 1M, and 1K which form images of yellow (Y), cyan (C), magenta (M), and black (K) respectively. It is noted that the color order of Y, C, M, and K is not limited by that of FIG. 1, and thus any other order can be used.

The image forming units 1Y, 1C, 1M, and 1K (also referred to as "image forming unit 1") include photosensitive drums 11Y, 11C, 11M, and 11K (hereinafter, "photosensitive drum or drums 11" unless otherwise specified) as image carriers, respectively, and each of the image forming units also includes a charging unit, a developing unit, and a cleaning unit. The image forming units 1Y, 1C, 1M, and 1K are arranged so that rotating axes of the photosensitive drums are parallel to each other and are set so as to be arrayed at a predetermined pitch in a direction of movement of a transfer sheet.

An optical writing unit 3 is arranged below the image forming units 1Y, 1C, 1M, and 1K.

The optical writing unit 3 includes a light source, a polygon mirror, an fθ lens, and a reflective mirror. The optical writing unit 3 radiates each surface of the image forming units 1Y, 1C, 1M, and 1K with each laser light while being scanned based on image data.

Arranged above the optical writing unit 3 is a primary transfer unit 6 as a belt driving device having a transfer conveyor belt 60 for conveying toner images of the image forming units so as to transfer the toner images by being superimposed on each other.

The transfer conveyor belt 60 is wound around a plurality of rollers, and one of stretched faces of the transfer conveyor belt 60 is in contact with and moves along the photosensitive drums 11 in the image forming units. A cleaning unit 61 that includes a brush roller and a cleaning blade is arranged in an outer corner so as to be in contact with the transfer conveyor belt 60. A transfer element is not limited by the transfer conveyor belt and a drum can also be used.

The cleaning unit 61 removes foreign matters such as toner adhering to the transfer conveyor belt 60.

A secondary transfer unit 7 that transfers the toner image to a transfer sheet of paper is arranged on the right side of the primary transfer unit 6 as shown in FIG. 1, and a fixing unit 8 using a belt fixing method is provided above the secondary transfer unit 7.

Paper feed cassettes 4*a* and 4*b* in which transfer sheets S are set are provided below the image forming apparatus 1000. The image forming apparatus 1000 also includes a manual feed tray 4*c* used to manually feed a sheet of paper from the side of the image forming apparatus, separately provided from the paper feed cassettes 4*a* and 4*b*. As shown in FIG. 1, toner supply containers 5Y, 5C, 5M, and 5K are arranged in an upper space of the transfer conveyor belt 60, and waste toner bottles and a power supply unit (not shown) are also provided therein. Reference numeral 100 of FIG. 1 indicates a scanner that optically reads an image of a document and outputs photoelectrically converted image data.

Developing units 10Y, 10C, 10M, and 10K as shown in FIG. 1 as developing units are configured in the same manner as one another, and thus, a developing unit 10 corresponding to each of the developing units is shown in FIG. 2. A two-component developing method of using only different colors of toner is used in the developing units 10Y, 10C, 10M, and 10K, each in which a developer containing toner and magnetic carrier is accommodated.

Each of the developing units 10Y, 10C, 10M, and 10K includes a developing roller 12 provided facing the photosensitive drum 11, a screw for conveying and stirring the developer, and a toner density sensor although the details thereof are not explained below.

As shown in FIG. 2, an optical reflection type of image-density detection sensor 16 is provided in a photosensitive element 2. More specifically, the image-density detection sensor 16 detects the density of a toner image formed on the photosensitive drum 11, and is provided at a position after the image is developed and before the toner image is transferred. The image-density detection sensor 16 is provided at three locations such as a center and both sides in a main scanning direction. A control unit 200 (FIG. 3) uses an average value of data detected at the three locations of the image-density detection sensors 16. It is noted that an example of arrangement of the image-density detection sensors 16 and an example of how to acquire data are not limited by the above example. It may be configured to detect not a toner image on the photosensitive drum 11 but, for example, detect the density of a toner image after it is transferred to the transfer conveyor belt 60.

The developing roller 12 is formed with a rotatable sleeve provided outside thereof and a magnet fixed in the internal side thereof. The developing unit 10 is supplied with toner by the toner supply device according to an output of the toner density sensor.

In the image forming apparatus 1000, at first, a predetermined voltage is applied to a charging roller 14 (see FIG. 3) from a power supply (not shown), and the charging roller 14 charges an opposed surface of the photosensitive drum 11. Subsequently, the optical writing unit 3 scans a laser light based on image data on the surface of the photosensitive drum 11 charged to a predetermined potential, and writes an electrostatic latent image on the surface thereof. When the surface of the photosensitive drum 11 that carriers thereon the electrostatic latent image reaches the developing unit 10, the developing roller 12 arranged facing the photosensitive drum 11 supplies toner to the electrostatic latent image on the surface of the photosensitive drum 11, to form a toner image thereon.

The operations are performed on all of photosensitive elements 2Y, 2C, 2M, and 2K (not shown but represented by the photosensitive element 2 in FIG. 2) at a predetermined timing, and toner images of predetermined colors are formed on the surfaces of the photosensitive drums 11Y, 11C, 11M, and 11K respectively.

The transfer sheet S is conveyed from any one of the paper feed cassettes 4*a* and 4*b* or the manual feed tray 4*c*, and temporarily stops when the transfer sheet S reaches registration rollers 4. The toner images on the photosensitive drums 11 are sequentially transferred to the transfer conveyor belt 60 at each image forming timing of the photosensitive elements 2Y, 2C, 2M, and 2K. The toner images are transferred by applying a voltage having a reverse polarity to the polarity of toner on each of the photosensitive drums 11 by the power supply (not shown) from primary transfer rollers 67Y, 67C, 67M, and 67K arranged opposite to the photosensitive drums 11Y, 11C, 11M, and 11K respectively through the transfer conveyor belt 60.

The transfer conveyor belt 60 passes through an opposite position to the photosensitive drum 11K, and a toner image obtained by superimposing the toner images of the four colors on each other is transferred to the transfer sheet S sent by the registration rollers 4 by using the secondary transfer unit 7. The transfer sheet S is further conveyed to the fixing unit 8, where the toner image is fixed on the transfer sheet S by heat and pressure.

The image forming apparatus 1000 having the configuration as explained above is further configured to predict the occurrence of a malfunction of a device used for the image forming process and prevent the occurrence of downtime of the device due to the occurrence of an unexpected malfunction.

Figure 3:
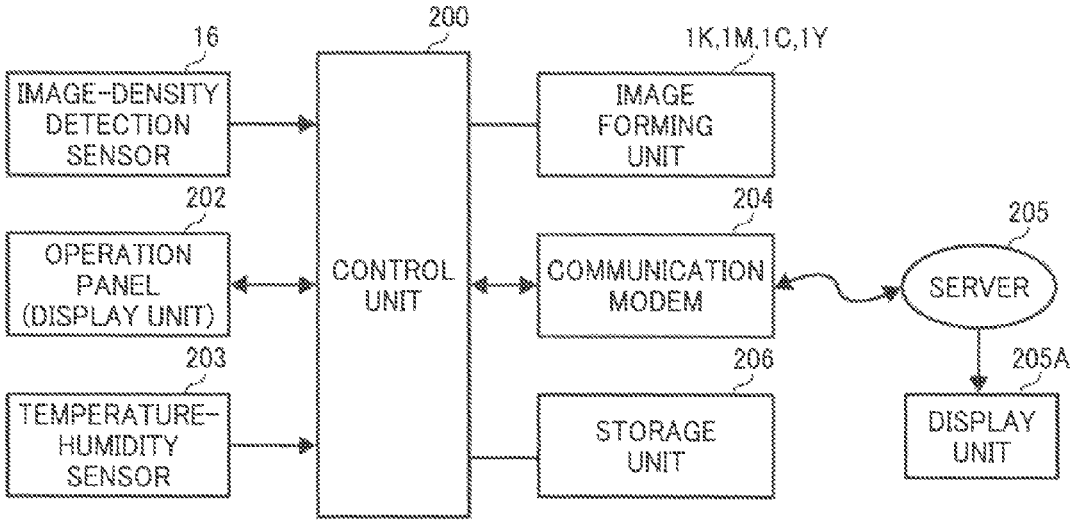
FIG. 3 is a block diagram of a main configuration of a control system in the image forming apparatus of FIG. 1.

FIG. 3 is a block diagram of the control unit used to predict the occurrence of a malfunction. The control unit 200 is formed with a microcomputer that executes the process sequence for image formation. As a configuration related to the embodiment, those as follows are connected to the input side of the control unit 200 through an interface (not shown). More specifically, these are the image-density detection sensor 16 (see FIG. 2) that detects a toner adhesion amount on an image-density-detection pattern image formed on the transfer conveyor belt 60 or formed on the photosensitive drum 11 before it is transferred, an operation panel 202 that includes a liquid-crystal display unit, and a temperature-humidity sensor 203 that detects temperature and humidity at a location where the image forming apparatus 1000 is installed.

Connected to the output side of the control unit 200 are a communicating unit (communication modem 204 in FIG. 3) 204 used to connect the image forming apparatus to a network, the image forming units 1K, 1M, 1C, and 1Y, and a storage unit 206 that stores therein results of predicting occurrence of a malfunction, explained later.

A reflection-type optical sensor is used for the image-density detection sensor 16. According to this embodiment, the reflection-type optical sensor receives a reflected light from an image-density-detection pattern image to detect a toner adhesion amount according to the image density. The operation panel 202 is used to instruct image formation using information such as setting of the number of sheets to be output and the setting of density, and to display thereon the various information including the number of sheets to be output. The operation panel 202 also displays thereon information, such as the number of sheets to be output and a remaining time before a malfunction may occur and even a call to a repair person, used as information for the result of predicting malfunction occurrence according to the present embodiment.

The communicating unit 204 can communicate, via the network, with a server 205 provided in a service center or the like where a repair person is on duty. The server 205 includes a display unit 205A that can display thereon information transferred from the control unit 200.

The control unit 200 performs a malfunction-occurrence prediction process for a charging unit used in a charging process which is an essential process in the image forming process by using the control of image density used for ordinary process control.

The contents of the malfunction-occurrence prediction process in a charging unit 15 are as follows.

The control unit 200 changes a developing bias condition that affects the image density while a charging potential in the charging unit 15 is kept to be constant, and forms an image-density-detection pattern image. The control unit 200 further determines a toner adhesion amount based on a detected value (Vsp) of the image density, and compares the determined toner adhesion amount with a toner adhesion amount as normal under the set developing bias condition. The toner adhesion amount as the normal in this case corresponds to a toner adhesion amount as a reference set based on a background potential on the photosensitive element by the charging unit 15 obtained at an initial state of the devices corresponding to the time of shipment of the image forming apparatus including the charging unit 15, and also based on the developing bias with which the corresponding normal image density is obtained. Therefore, if the charging unit 15 has degraded with the passage of time, the obtained toner adhesion amount may be different from the normal toner adhesion amount.

Figure 4:
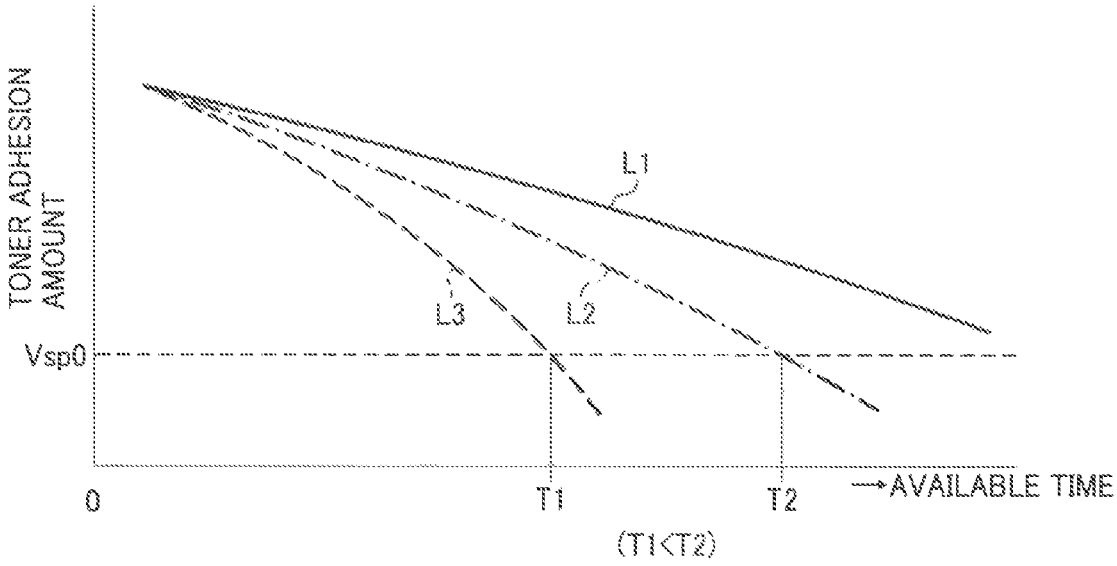
FIG. 4 is a graph of determination criteria to predict occurrence of a malfunction used in FIG. 3.

FIG. 4 is a graph of image density based on the degree of degradation of the charging unit, namely a change in the toner adhesion amount when the developing bias condition is changed from its initial condition to a certain condition. Reference symbol L1 in FIG. 4 indicates a toner adhesion amount as normal, while reference symbols L2 and L3 indicate results of toner adhesion amounts when the developing bias condition is changed.

As shown in FIG. 4, as indicated by L2 and L3 with respect to the toner adhesion amount as normal, there is a plurality of detection patterns. This is because the image density changes in different ways according to the degree of degradation of the charging unit. The detection patterns indicate decreasing rates of the image density which are quantified through experiments. Specifically, the decreasing rates are based on a relationship between the change of a surface potential on the photosensitive element due to degradation of the charging unit with the passage of time and the setting condition of the developing bias. Therefore, if the detection pattern as indicated by L3 in FIG. 4 is obtained, then this case indicates that the charging unit 15 is degraded more than the case of the detection pattern as indicated by L2.

As shown in FIG. 4, when the image density i.e. toner adhesion amount is plotted on the y axis, the x axis indicates a time until the charging unit becomes unavailable which is one of the contents of the malfunction occurrence. The time corresponds to an available time according to the degradation of the charging unit 15. In the present embodiment, the degradation rate of the charging unit 15, namely, the decreasing rate of the image density under an arbitrary developing bias condition is previously obtained through experiments, and each available time corresponding to the decreasing rate is formed as a list.

A period during which a malfunction occurs is indicated by reference symbol Vsp0 in FIG. 4, and the period indicates a limit at which the toner adhesion amount corresponding to a predetermined image density cannot be obtained. If the decreasing rate of the toner adhesion amount is higher, the available time becomes shorter with respect to the period of the occurrence when the developing bias condition which is changed from the initial condition is used (the time indicated by T1 is shorter than the time indicated by T2 in FIG. 4 as a period from an initial time).

According to the present embodiment, the control unit 200 sets a time until the charging unit 15 becomes unavailable, as a target to predict malfunction occurrence, and stores the result of prediction in a display unit of the operation panel 202 and in the server 205 of the service center via the network through the communicating unit 204. Therefore, the user can be alerted through the display unit of the operation panel 202 or the repair person can be alerted through a display of the display unit 205A in the server 205.

On the other hand, when the available time of the charging unit is obtained in the malfunction-occurrence prediction process, the control unit 200 performs an assurance process in which image formation can be continued until devices other than the charging unit 15 become unavailable. The process is a content as follows.

When the time until the devices will be unavailable is determined, the control unit 200 changes the developing bias condition so as to compensate for the decreasing rate of the image density obtained according to the degree of degradation of the charging unit 15. In other words, the decrease in the image density can be regarded as the decrease in the toner adhesion amount, and thus the developing bias that affects the adhesion of toner is increased. The increasing rate in this case is set as a value such that a comparison is made between a decreased portion of the background potential on the photosensitive element and the background potential at a normal state, and that the value can compensate for the shortfall in the toner adhesion amount due to the obtained difference.

The malfunction-occurrence prediction process according to the present embodiment can be performed automatically or in an arbitrary manner. The case where it is performed automatically corresponds to those as follows, a case where the number of output sheets reaches a predetermined number in the control unit 200 and a case where environmental temperature/humidity affects charging characteristics. The case in the arbitrary manner includes inspection by the repair person.

Figure 5:
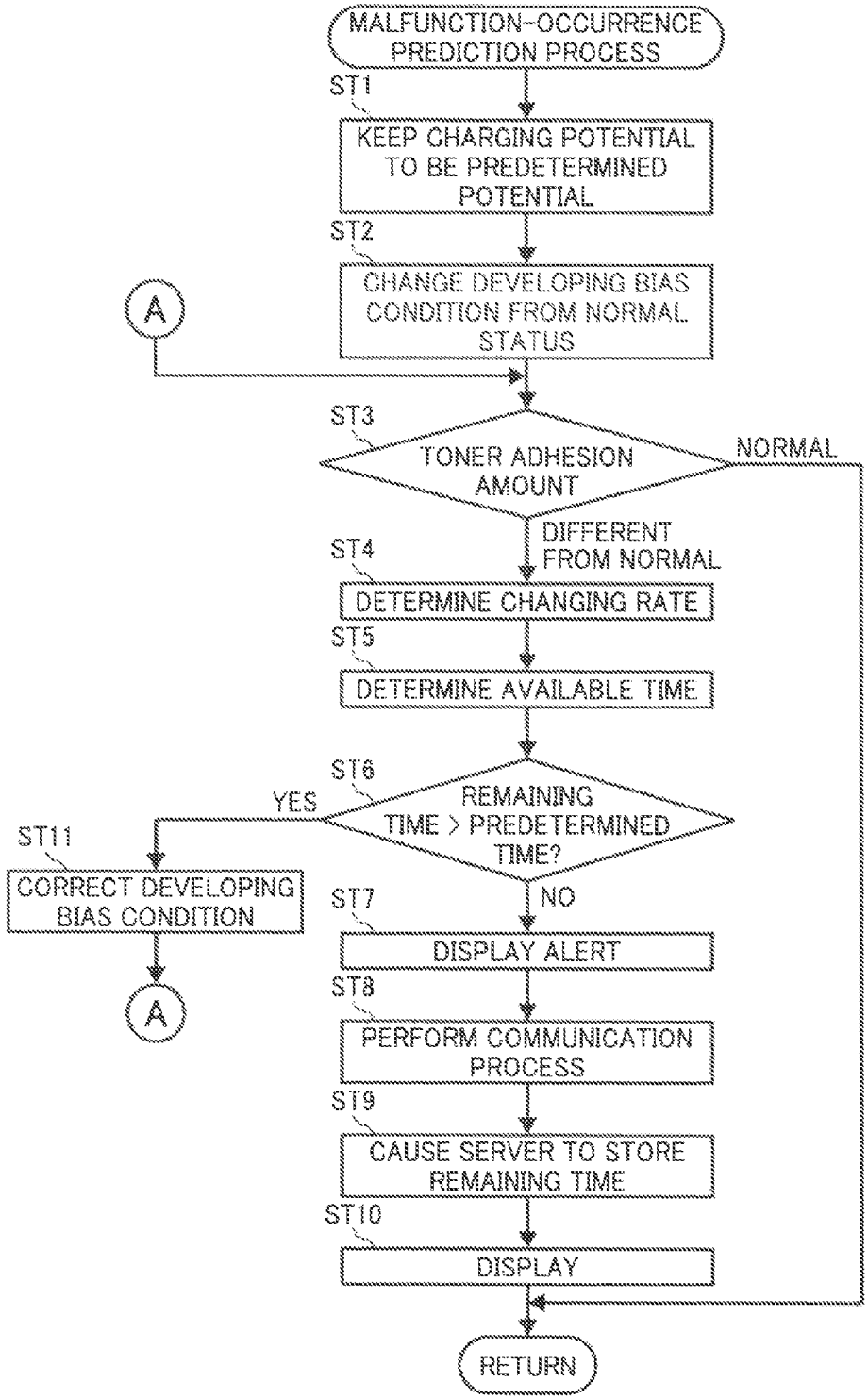
FIG. 5 is a flowchart of a malfunction-occurrence prediction process in the image forming apparatus according to the present invention.

The present embodiment is configured in the above manner, and the functions of the control unit 200 are explained below with reference to FIG. 5.

When the image forming apparatus 1000 is started, information is input from the temperature-humidity sensor 203 in accordance with initialization of the process control, and an image formation instruction is waited from the operation panel 202 if the information is in predetermined conditions. If the information is a condition of predicting malfunction occurrence, a routine of a malfunction-occurrence prediction process is executed.

In the routine of the malfunction-occurrence prediction process, the charging potential on the charging unit 15 is kept to be constant (Step ST1), and the developing bias condition is changed from its normal status (Step ST2). An image-density-detection pattern image formed based on the change of the developing bias condition is set as a target, and a toner adhesion amount of the target is detected, to determine whether the toner adhesion amount is equivalent to the normal state (Step ST3). The determination made in this case is compared with the normal amount obtained under the developing bias condition in which the toner adhesion amount has been changed. When the toner adhesion amount is different from the normal amount as a result of the comparison, each changing rate is also determined. As indicated by L2 and L3 shown in FIG. 4, the determined results are represented with respect to an available time map using the changing rate previously obtained through the experiments (Step ST4).

When the toner adhesion amount is different from the normal amount, it is determined that the charging unit 15 has degraded with the passage of time, and an available time is determined according to the changing rate using the map shown in FIG. 4 (Step ST5). A remaining available time is compared with an available time specified for the charging unit 15, and is compared with a predetermined time i.e. the time during which a malfunction will not immediately occur and a certain amount of image output can be continued (Step ST6).

When the remaining available time is not more than the predetermined time, the control unit 200 causes the display unit of the operation panel 202 to display thereon alert information, and also causes the server 205 of the service center to store therein and display thereon the alert information with the remaining time information through the communication process using the communicating unit 204 via the network (Steps ST7 to ST10). These processes allow the user to confirm the display content and to determine how long the image forming operation can be continued or whether the user has to make a call to the repair person. At the service center, the repair person checks the information stored in the server 205 and the display content without visiting each user, and visits the user only when it is necessary.

On the other hand, when the remaining available time is not less than the predetermined time, the control unit 200 changes the developing bias condition, sets a condition so that a predetermined image density is obtained, and can continue the image formation (Step ST11). Accordingly, images can be output by the time a malfunction occurs. Therefore, it is prevented that the imaging process is suddenly interrupted, and the user can thereby obtain an image output in good time until the user makes a call to the repair person.

Therefore, according to the embodiment as explained above, by comparing a change of the toner adhesion amount when the developing bias condition is changed with the normal toner adhesion amount, it is possible to predict malfunction occurrence in any device other than the device that uses the developing bias condition changed based on the degree of the change. Accordingly, it is possible to prevent interruption of the operation due to sudden malfunction occurrence.

According to a second embodiment of the present invention, an abnormality detection image in which an image becomes easily abnormal due to the charging unit is automatically output according to the use environment of the device and is read. By comparing the input image with the output image, it is determined whether any abnormality due to the charging unit occurs in the image. When the image is abnormal, the level of the abnormality is ranked, and the abnormal image is notified to the user, an administrator, and the service center depending on the rank via the network. The notification allows the user to replace the charging unit or a unit formed with the charging unit before an abnormality appears in the image in ordinary use.

Furthermore, the setting is automatically reset to setting, such as widening of background potential, at which the abnormal image due to the charging unit is difficult to occur, depending on the determination result. Thus, the downtime until the unit is replaced can be reduced to as near as zero as possible.

An image that easily causes an abnormal image due to the charging unit is output while the ground potential in the abnormality detection image is changed step by step, which makes it possible to predict a possibility for an image that will become abnormal before the image becomes abnormal in ordinary use.

A unit that can obtain the status of the unit is further provided, which makes it possible to obtain the life of each unit which is roughly determined in the conventional technology, in individual devices and units, and to reduce costs due to the unit replacement.

The image forming apparatus configured as shown in FIGS. 1 to 3 is explained below as an example.

The repair person outputs the abnormality detection image at an arbitrary time and causes a scanner 100 to automatically or manually read the output image. The abnormality detection image to be output in this case is output in such a manner that the condition is temporarily set to a condition at which an abnormal image due to the charging unit 15 is easily output by changing the background potential which is a difference between a surface potential of the photosensitive drum 11 and the developing bias. With this feature, by comparing the image data input by the scanner 100 with the image data formed by the image forming unit 1, the possibility for occurrence of the abnormal image can thereby be detected before the image becomes abnormal due to the charging unit 15 in ordinary use.

Although the time at which the abnormality detection image is output may be any time, it is also possible to automatically determine an appropriate output time depending on the environment where the image forming apparatus 1000 is installed or on its usage. The abnormality detection image output herein should not be charged (a charge called "performance charge" which is collected at every time or a plurality of times an image is formed).

The device ranks abnormality of each image read in the above manner according to its level, and notifies the service center of the read content through the network. Based on the notification, the repair person may visit the user, or may cause the display of the device or a driver of personal computer (PC) to display thereon prediction information for abnormality occurrence.

In addition, when the unit itself such as the photosensitive element 2 includes an information recording medium, the information ranked in the above manner is stored in the recording medium. Thus, even if the unit is attached to another device, the status of the unit itself can be notified to the device according to an operational method of the unit.

On the other hand, when the abnormality detection image is read and it is predicted that an abnormality will occur in near future, the condition is temporarily set to an imaging condition under which an image hardly becomes abnormal due to charging until the predicted time, and the use of the device can thereby be continued.

One example of the imaging condition of the abnormality detection image is explained below. Although the example explained below is an output of an abnormality detection image in which the background potential is changed, the present invention is not limited by this example.

Figure 6:
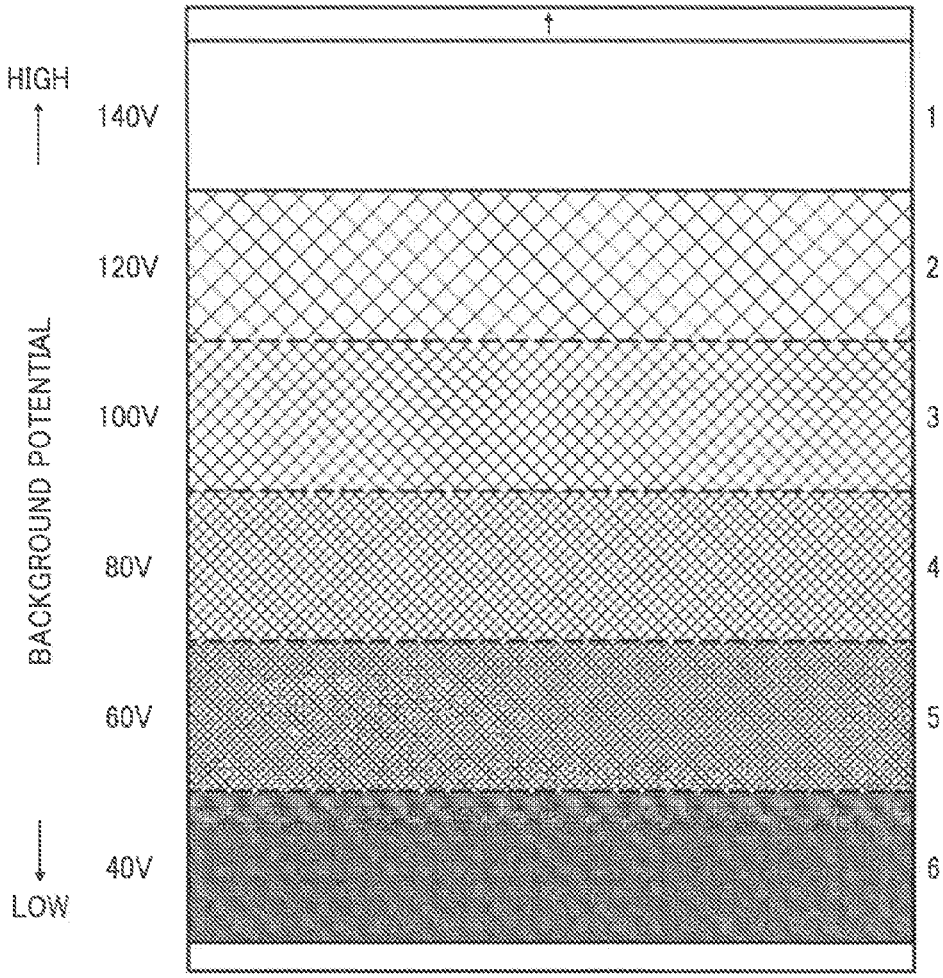
FIG. 6 is a schematic for explaining an example of abnormal image formation in which areas having different background potentials are formed stepwise in a sheet of paper.

At first, when the abnormality detection image is to be output, it is basically set that a charging DC/developing bias used at that time upon imaging is used or a charging DC/developing bias as a fixed value is used. As an example, if a developing bias (Vb) upon normal imaging operation is −700 Volt and a charging DC bias (Vc) is −840 Volt, and if a set value of the charging DC bias is set to a value lower by 140 Volts than a set value of the developing bias, then the background potential is 140 volts. If writing is not performed using the developing bias (Vb)=−700 Volt and the charging DC bias (Vc)=−840 Volt, the portion to be written is naturally blank. The charging DC bias (Vc) is gradually increased by 20 Volts each from −840 Volt, −820 Volt, −800 Volt . . . −740 Volt from the edge of an image area while the developing bias (Vb) is fixed as it is. A conceptual diagram of the image area becomes such that as shown in FIG. 6, where areas each of which has a different background potential are formed stepwise in a sheet of A3-size paper.

The above example is the case where writing is not performed. However, in the case of writing a halftone on a 2-by-2 whole image, the bias is also set in the above manner. In this case, the areas having different background potentials from each other are formed stepwise in the whole halftone image.

A discriminating unit and ranking of the abnormality detection image are explained below. The discrimination of the abnormality detection image output in the above manner is roughly implemented by three methods, a method of reading an output sheet by the scanner 100, a method with which the repair person visually determines the output sheet, and a method with which a sensor detects an image on the image carrier. As one example, the method of reading the output sheet by the scanner 100 is explained below, however, the present invention can be implemented by using the other methods.

At first, the abnormality detection image output on the sheet in the above manner is read by the scanner 100. The output image is determined by using a determining unit formed with a built-in microcomputer in the image forming apparatus 1000 or with software having predetermined functions. When the determination is to be made, at first, numbers are assigned to the background potentials from the higher background potential like, for example, numerals 1 to 6 described along the right edge of FIG. 6. Next, the read images are determined for each of the areas. At this time, it is assumed that the areas are where a vertical color streak due to contamination of the charging roller easily appears in the order of the numbers 1 to 6. When the charging roller 14 may cause the color streak to appear in a subsequent imaging process, for example, when the color streaks are assumed to appear in the areas with the number 4 and thereafter, the areas with the number 4 and thereafter are detected and determined by using, for example, a method of pattern matching.

Thereafter, if a threshold indicating a near end of the life of the charging unit 15 is set to a case where the color streak may appear in the area with the number 4, an alert message may be displayed on the display unit of the operation panel 202, or a "near-end" alert may be sent to any of other terminals via the network if the terminal is connected to the network. It is noted that the method used to make determination and the devices are not limited by the example, and thus various methods and devices can be employed.

As explained above, the abnormality detection image in which an image becomes easily abnormal due to the charging unit 15 is automatically output according to the use environment of the device and is read. And by comparing the input image with the output image, it is determined whether any abnormality caused by the charging unit 15 appears in the image. When it appears, the level of the abnormal image that appears is ranked, and the abnormal image is notified to the user, the administrator, or the support center depending on the rank via the network. With this feature, the charging unit 15 or the unit including the charging unit 15 can be replaced before the image becomes abnormal in ordinary use. Depending on the result of determination, the setting is automatically reset to the setting, such as widening of background potential, at which the abnormal image due to the charging unit is difficult to occur. Thus, the downtime until the unit is replaced can be reduced to as near as zero as possible.

Furthermore, an image in which an abnormal image due to the charging unit 15 easily appears is output while the background potential is changed step by step in the abnormality detection image, which makes it possible to predict the possibility for occurrence of an abnormal image before the image becomes abnormal in ordinary use. Moreover, the unit that can learn the status of the unit is provided, which makes it possible to obtain the life of each unit which is roughly determined in the conventional technology, in individual devices and units, and to reduce costs due to the unit replacement.

More specifically, by using the image forming apparatus that has the abnormal image detection method according to the present invention, it can be predicted that an image will become abnormal due to the charging unit 15 before the image becomes abnormal due to the charging unit 15 in ordinary use. Thus, it is possible to ensure the time required for replacement of the charging unit 15 or of the unit including the charging unit 15 to recover the abnormal image. Moreover, by detecting an abnormal image due to the charging unit which largely affects the life of the unit, this can make maximum use of the life of the charging unit 15 or of the unit including the charging unit 15, and reduce the costs due to the unit replacement.

As described above, according to one aspect of the present invention, by comparing changes of the toner adhesion amount when the developing bias condition is changed with respect to the toner adhesion amount in the normal status, it is possible to predict occurrence of a malfunction of a device other than the device using the developing bias condition changed according to each degree of changes. Accordingly, the interruption of operation due to sudden occurrence of a malfunction can be prevented.

Furthermore, according to another aspect of the present invention, the occurrence of the abnormal image due to the charging unit can be predicted before the image becomes abnormal due to the charging unit in ordinary use. Thus, it is possible to ensure the time required for replacement of the charging unit or of the unit including the charging unit to recover the abnormal image. Moreover, by detecting the abnormal image due to the charging unit which largely affects the life of the unit, this can make maximum use of the life of the charging unit or of the unit including the charging unit 15, and reduce the costs due to the unit replacement.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit that forms an electrostatic latent image on a photosensitive element by an electrophotographic process, and causes toner to adhere to the electrostatic latent image to form a visible image; and a control unit that controls the image forming unit, wherein at least a toner-adhesion-amount detector that detects a toner adhesion amount in an image-density-detection pattern image formed on the photosensitive element, an operating unit through which image formation is instructed, and a detection sensor that detects temperature and humidity in proximity of the image formation are connected to an input side of the control unit, at least a developing bias control unit that controls a developing-bias control condition in a developing process, a display unit that can display thereon a malfunction, and a communicating unit that displays a malfunction on an external device via a network are connected to an output side of the control unit, and the control unit changes the developing-bias control condition from its normal status, forms the image-density-detection pattern image under the developing-bias control condition which has been changed, detects a toner adhesion amount in the formed image-density-detection pattern image, compares changes of the toner adhesion amount which has been detected with respect to a toner adhesion amount in the image-density-detection pattern image obtained at an initial state of the image forming apparatus, performs a malfunction-occurrence prediction process according to a degree of each of the changes in density, and displays a result of the malfunction-occurrence prediction process.

2. The image forming apparatus according to claim 1, wherein the control unit keeps a condition provided in a device used in a charging process to be constant when the developing-bias control condition is changed, and predicts a malfunction occurrence in the image forming unit used in the charging process.

3. The image forming apparatus according to claim 1, wherein the control unit changes an imaging condition in a process other than a charging process to a condition under which the toner adhesion amount is made appropriate, according to a result of predicting a malfunction occurrence in the image forming unit used in the charging process.

4. The image forming apparatus according to claim 1, wherein the control unit causes a server connected thereto through the communicating unit via the network to output and store therein prediction of a malfunction occurrence and to display thereon the prediction of the malfunction occurrence.

5. The image forming apparatus according to claim 1, wherein the control unit causes a display unit of the operating unit to output and display thereon prediction of a malfunction occurrence.

6. The image forming apparatus according to claim 1, wherein the control unit executes the malfunction-occurrence prediction process according to an output from the detection sensor or the number of outputs of formed images.

7. The image forming apparatus according to claim 1, wherein the control unit executes the malfunction-occurrence prediction process according to an instruction from the operating unit.

8. The image forming apparatus according to claim 1, wherein the control unit further includes an information storage unit that stores therein a result of predicting a malfunction occurrence, and the result of predicting the malfunction occurrence stored in the information storage unit is readable.

* * * * *